US008863764B2

(12) United States Patent
Zarins et al.

(10) Patent No.: US 8,863,764 B2
(45) Date of Patent: Oct. 21, 2014

(54) STRONG AND VERSATILE SPIKE ATTACHMENTS FOR WALKING STICKS AND CANES, RETRIEVING STICKS, AND MISCELLANEOUS WALKING ASSISTANCE DEVICES

(71) Applicants: Andris Zarins, Ostrander, OH (US); Markus Daniels Zarins, Powell, OH (US)

(72) Inventors: Andris Zarins, Ostrander, OH (US); Markus Daniels Zarins, Powell, OH (US)

( * ) Notice: Subject to any disclaimer, the term of this patent is extended or adjusted under 35 U.S.C. 154(b) by 0 days.

(21) Appl. No.: 13/815,135

(22) Filed: Feb. 2, 2013

(65) Prior Publication Data

US 2013/0199588 A1 Aug. 8, 2013

Related U.S. Application Data

(60) Provisional application No. 61/633,148, filed on Feb. 6, 2012.

(51) Int. Cl.
*A45B 9/04* (2006.01)

(52) U.S. Cl.
CPC ..... *A45B 9/04* (2013.01)
USPC ..... 135/77

(58) Field of Classification Search
CPC ..... A45B 9/04; A61H 3/0288
USPC ..... 135/77, 78; 16/108, 109; 248/188.9
See application file for complete search history.

(56) References Cited

U.S. PATENT DOCUMENTS

| | | | | | |
|---|---|---|---|---|---|
| 47,695 | A * | 5/1865 | Bickel | 135/78 |
| 281,245 | A * | 7/1883 | Degenhart | 135/65 |
| 415,511 | A * | 11/1889 | Howgate | 135/81 |
| 703,457 | A * | 7/1902 | Perdelwitz | 135/77 |
| 1,305,867 | A * | 6/1919 | Atlas | 135/78 |
| 1,674,065 | A * | 6/1928 | Rogers | 36/62 |
| 1,709,686 | A * | 4/1929 | Ryan | 135/80 |
| 2,116,941 | A * | 5/1938 | Francis | 135/78 |
| 2,266,657 | A * | 12/1941 | Rivers | 294/61 |
| 2,367,105 | A * | 1/1945 | Donaldson | 294/61 |
| 2,376,282 | A * | 5/1945 | Schroeder | 135/81 |
| 2,631,597 | A * | 3/1953 | Phinney | 135/78 |
| 2,799,287 | A * | 7/1957 | Wagner | 135/77 |
| 3,177,884 | A * | 4/1965 | Thro | 135/77 |
| 3,949,773 | A * | 4/1976 | Marescalco | 135/78 |
| 4,411,284 | A * | 10/1983 | Opitz | 135/81 |
| 4,964,430 | A * | 10/1990 | Janis | 135/78 |
| 5,069,102 | A * | 12/1991 | Wolf | 84/280 |
| 5,103,849 | A * | 4/1992 | Hamner | 135/77 |
| 5,377,710 | A * | 1/1995 | Laser | 135/66 |
| 6,216,713 | B1 * | 4/2001 | Kennan | 135/78 |
| 2005/0205121 | A1 * | 9/2005 | Lindgren | 135/78 |

* cited by examiner

*Primary Examiner* — Noah Chandler Hawk

(57) ABSTRACT

Solid metal components welded together result in Strong and Versatile Spike Attachments for Walking Sticks and Canes, Retrieving Sticks, and Miscellaneous Walking Assistance Devices design, which coupled with the semi-flexible attachment design and with several sizes being available, may be attached to existing walking and retrieving sticks, canes, crutches, walkers, etc. Since a precise fit is not necessary, the user can make or have made a customized walking or retrieving stick or a cane as to a desired size, overall length, curvature, texture, twist, weight, etc., from readily available materials. This spike and spike attachment invention should be very beneficial for snow and ice conditions or steep and slippery slopes for avid hikers, all walkers, and especially for people that are not secure on their feet without some assistance.

1 Claim, 2 Drawing Sheets

STRONG AND VERSATILE SPIKE ATTACHMENTS FOR WALKING STICKS AND CANES, RETRIEVING STICKS, AND MISCELLANEOUS WALKING ASSISTANCE DEVICES

CROSS-REFERENCE TO RELATED APPLICATIONS

This application claims the benefit of US Provisional Patent Application No. 61/633,148 entitled "Strong and Versatile Spike Attachments for Walking Sticks and Canes, Retrieving Sticks, and Miscellaneous Walking Assistance Devices" filed on Feb. 6, 2012, which is hereby incorporated by reference. The Inventors for the subject Provisional Patent and the Nonprovisional Patent Application are Andris Zarins and Markus Daniels Zarins. The Inventors are not aware of any need for a Cross-Reference To Related Applications, since their Invention is unique.

BACKGROUND OF THE INVENTION

The Inventors had relatives and friends that needed walking assistance devices. One of the store bought canes broke in the first few days of use. The Inventors searched stores for strong and sturdy walking assistance devices, but could not find any to their satisfaction that could be used for icy or snow conditions. The Inventors had some discussions, thought about the problem, and tried installing a steel screw or spike into a wooden shaft. The results were not satisfactory. The Inventors then tried several versions of the Strong and Versatile Spike Attachments for Walking Sticks and Canes, Retrieving Sticks, and Miscellaneous Walking Assistance Devices (For convenience, hereafter referred to as Strong and Versatile Spike Attachments or Spike Attachments or Spike Attachment.) that can be attached to many existing walking assistance devices, can be used for a new rough trimmed shaft, and that are the subject of this Nonprovisional Patent Application. The beauty of this invention is that with several sizes available and with a semi-flexible attachment design, an existing shaft or a shaft made for a new walking assistance device, does not require a precise fit.

After conception, model building, and trial usage the subject Inventors have completed a very extensive investigation of published patents for subjects, such as, walking sticks, canes, crutches, walkers, retrieving sticks, spikes, ice grips, tools, etc. The Inventors of this patent application could not find any with the same design or design concept. The only concerns the Inventors have about this Invention are that machine shops that made these devises for the Inventors or people that have seen this Invention may have filed for a patent. Also, the Inventors gave out several of these devices attached to walking sticks or canes to friends and relatives to use and try out. To the best knowledge of the subject Inventors, no reference to another patent is needed nor required for the subject Nonprovisional Patent Application.

BRIEF SUMMARY OF THE INVENTION

The Strong and Versatile Spike Attachments for Walking Sticks and Canes, Retrieving Sticks, and Miscellaneous Walking Assistance Devices (For convenience, hereafter referred to as Strong and Versatile Spike Attachments or Spike Attachments or Spike Attachment.) can be made from a variety of materials and metals. For the time being several sizes with several options for spike lengths machined from steel products is the plan. In general, this invention is labor, machine shop, and welding intensive in order to obtain durability, flexibility, and strength for the Spike Attachments by using steel for proven weld adherence. Other metals could be used, but the cost may be higher, while the strength and durability may be questionable. Likewise this Spike Attachment concept could be made by a mold process from various metals, plastics, and rubber, etc., after demonstration that sufficient strength, flexibility, and durability are attained.

The original concept of this invention was that these designed Spike Attachments could be installed on the end of a cut tree sapling by trimming off the bark and rough trimming so that precise trimming for a fit would not be required. Rough trimming would be sufficient, due to an attachment system of semi-flexible steel straps used as the attachment mechanism. The walking or retrieving stick or cane user could select a Spike Attachment size and spike length to make or have made for them a customized walking or retrieving stick or a cane of desired size, overall length, twist, curvature, texture, weight, etc., that could even be fitted for one arm or either arm.

The original idea for a walking stick was to have a spike at one end and a store bought rubber or plastic cap, as from a cane or chair leg cushioning cap, on the other end. A major utility of this walking stick concept would be to use the spike for assisted walking on ice, snow, and steep slopes. The rubber or plastic end cap could be used for general assisted walking and especially to assist walking on a slippery floor that may have water or snow from shoes or on shoe bottoms by simply flipping the stick. This walking stick could also be used in the dark to find holes and street curbs. Also this walking stick concept, especially with a lengthy spike could be used to ward off wild animals or attacking dogs, etc., especially by the avid hiker.

With the semi-flexible attachment design and with several sizes being available these Strong and Versatile Spike Attachments can also be attached to existing walking and retrieving sticks, canes, crutches, walkers, and other walking assistance devices, etc. The hand held part of the walking or retrieving stick or cane (the shaft) can be made from a variety of common items, such as, tree saplings; handles from shovels, hoes, and scrapers; metal or plastic pipes; and even dimensional lumber, such as, 2×2's. Once a Shaft is fitted to a Spike Attachment the Spike Attachment design allows the recommended attachment method of using store bought stainless steel pipe clamps to remove or install the Spike Attachment within a few seconds.

BRIEF DESCRIPTION OF THE SEVERAL VIEWS OF THE DRAWINGS

Drawing Figures

DRAWING REFERENCE NUMBER EXPLANATIONS

Figure 2:
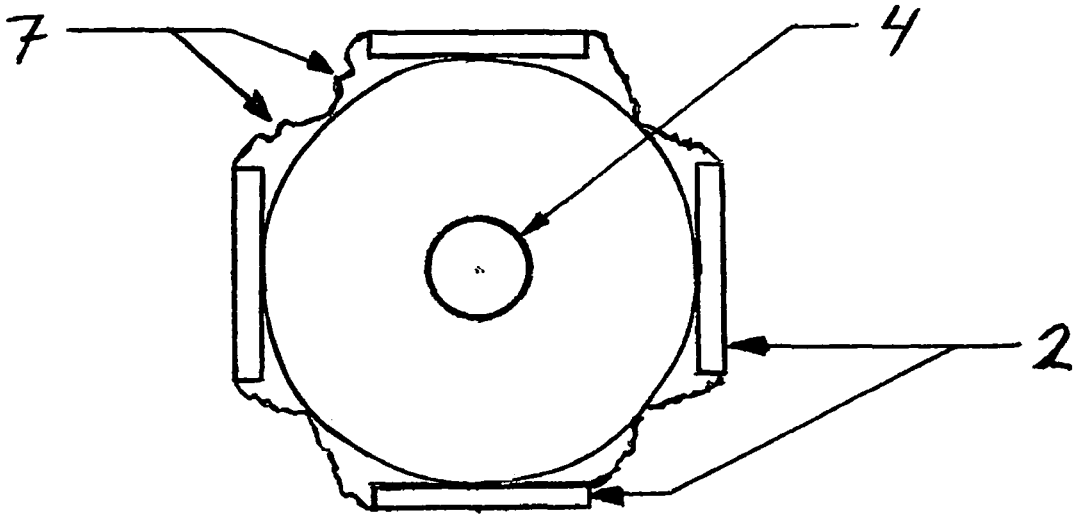
FIG. 2 is the top view of the Spike Attachment invention. (Page 2/2).
Figure 3:
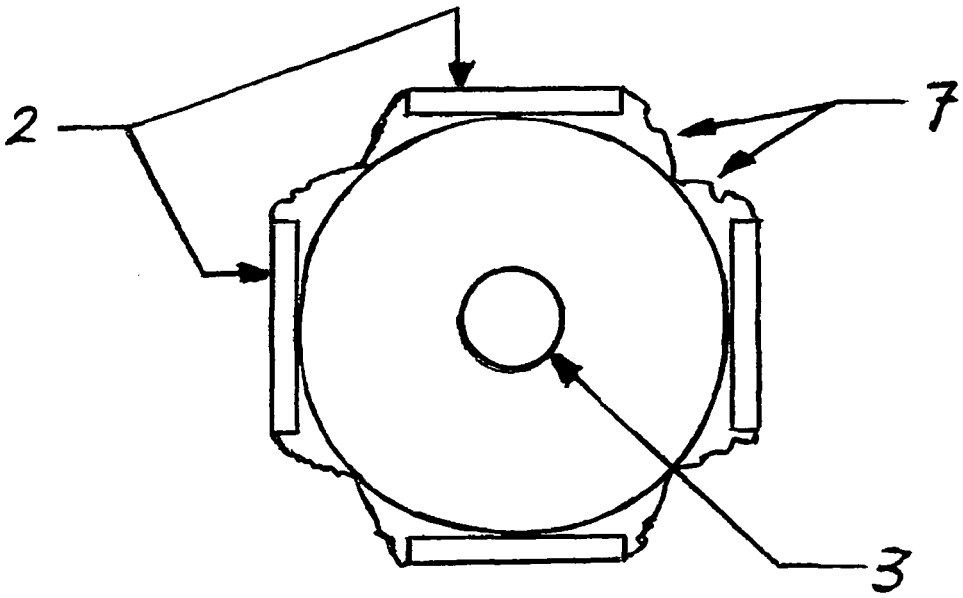
FIG. 3 is the bottom view of the Spike Attachment invention. (Page 2/2).

1—Steel Bar, generally round, used to attach the Steel Spike and Steel Straps. For clarification, the larger circles in FIG. 2 and FIG. 3 are the supporting Steel Bar as identified as #1 in FIG. 1.

2—Steel Straps that are attached to the Steel Bar and to the Shaft of the walking assistance device or the litter retrieving device.

3—The Spike, generally a smaller diameter steel rod that is inserted in a hole in the Steel Bar. The Spike is welded to the top and bottom of the Steel Bar.

4—A void that is left during assembly that is filled with welding material to attach the top of the Steel Spike to the top part of the Steel Bar to avoid significant welding material roughness against the Shaft bottom. A void to avoid welding material build up at the bottom of the Steel Bar is not generally necessary, but can be done to improve the cosmetics and effective Spike length, slightly.

5—The Shaft of the walking assistance device that is inserted between the Steel Straps. The recommended method to clamp the Steel Straps onto the Shaft is with stainless steel pipe clamps. Other attachment methods may be used as long as the attachment is well secured and the Shaft is not weakened and all Steel Straps at the same time help to distribute enacted forces.

6—The ice or ground with the walking assistance device in use to designate orientation.

7—Welding material to weld the bottom edges and the side edges of the Steel Straps to the Steel Bar. Other attachment methods and contact points may be used, but the concept is that the Steel Straps are well secured to the Steel Bar.

8—Welding material completely around the Spike to bond the bottom of the Steel Bar and the Spike together.

DETAILED DESCRIPTION OF THE INVENTION

Figure 1:
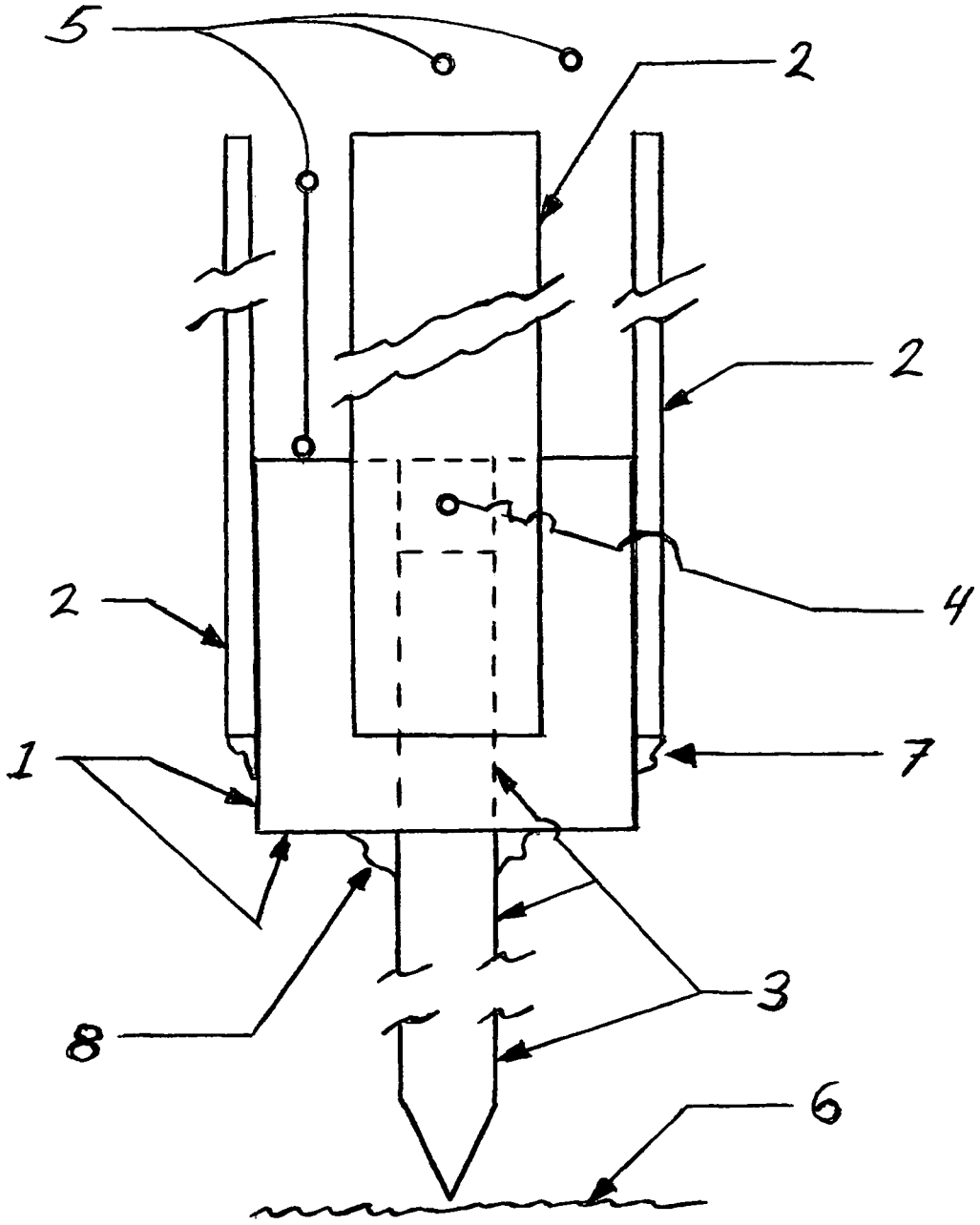
FIG. 1 is the front view of the Spike Attachment invention in an in use position with the spike pointing towards the ground. (Page 1/2).

The complete assembly for the Strong and Versatile Spike Attachments for Walking Sticks and Canes, Retrieving Sticks, and Miscellaneous Walking Assistance Devices (For convenience, hereafter referred to as Strong and Versatile Spike Attachments or Spike Attachments or Spike Attachment.) is shown in FIG. 1 that includes the Spike 3, the Steel Bar 1, and the Attachment Straps 2 that can be made from a variety of materials and metals. For the time being several sizes with several options for spike lengths machined from steel products is the plan. For example one version was to use a steel screw for the Spike 3, which still may be done in some cases. The disadvantages of using a steel screw for the Spike 3 are that removing dirt may be more difficult, weld bonding may not be as good, screw threads reduce the effective Spike 3 diameter, and additional trimming of the main Steel Bar 1 support may be required. The recommended method of attachment of the Strong and Versatile Spike Attachments to the Shaft 5 is with one or more stainless steel pipe clamps with threads as sold at plumbing supply stores.

In general, this Invention is labor, machine shop, and welding intensive in order to obtain durability, flexibility, and strength for the Spike Attachments by using steel for proven weld adherence. Other metals could be used, but the cost may be higher, while the strength, weld adherence, and durability may be questionable. Likewise this Spike Attachment concept could be made by a mold process from various metals, plastics, and rubber, etc., after demonstration that sufficient strength, flexibility, and durability are attained. The method of assembly of the completed Spike Attachment and the Shaft 5 is not being patented. The shape, design, size, and the use of the Spike Attachments are being patented. Thus, by whatever methods the Spike Attachments are made, this Invention will still be covered by this Patent.

The original concept of this Invention was that these designed Spike Attachments (complete assembly as per FIG. 1 that includes the Spike 3, the Steel Bar 1, and the Attachment Straps 2) could be installed on the end of a cut sapling tree by trimming off the bark and rough trimming so that precise trimming would not be required. Rough trimming would be sufficient, due to an attachment system of semi-flexible Attachment Straps 2 used as the attachment mechanism. The walking or retrieving stick or cane user could select a size of Spike Attachment and Spike 3 length to make or have made for them a customized walking or retrieving stick or cane as to a desired size, overall length, curvature, texture, twist, weight, etc. that could even be fitted for one arm or either arm. Once a Shaft 5 is fitted to a Spike Attachment the Spike Attachment design allows the user to install or remove the Spike Attachment within a few seconds when using the recommended attachment method of using store bought stainless steel pipe clamps.

The original idea for a walking stick was to have a Spike 3 at one end and a store bought rubber or plastic cap, as from a cane or chair leg cushioning cap, on the other end. A major utility of this walking stick concept would be to use the Spike 3 for assisted walking on ice, snow, and steep slopes. The rubber or plastic end cap could be used for general assisted walking and especially to assist walking on a slippery floor that may have water or snow from shoes or on shoe bottoms by simply flipping the stick. This walking stick could also be used in the dark to find holes and street curbs. Also this walking stick concept could be used to ward off wild animals or attacking dogs, etc., especially for the avid hiker with a longer Spike 3.

With the semi-flexible attachment design and with several sizes being available these Strong and Versatile Spike Attachments can also be attached to existing walking and retrieving sticks, canes, crutches, walkers, and other walking assistance devices, etc. The hand held part of the walking or retrieving stick or cane, the Shaft 5, can be made from a variety of common items, such as, tree saplings; handles from shovels, hoes, and scrapers; metal or plastic pipes; and even dimensional lumber, such as, 2×2's. The Inventors also plan to make walking and retrieving stick Shafts 5 that are not part of this patent application to insert into the Spike Attachments that are being patented.

Strap Attachment 2 to the Shaft 5 can be accomplished by a variety of methods, anywhere from nails, screws, tacks, wire, clamps, adhesives, etc. These attachment methods may still be done in some cases, but are not the preferred method due to additional cost and may result in a weakened Shaft 5. For this invention, for the time being, strips of sheet metal (Steel Straps) 2 will be welded to round Steel Bars 1 that will be attached to the Shaft 5 by store bought stainless steel pipe clamps with a threaded mechanism that are typically tightened with a screwdriver or wrench. An essential part of this invention are the strong and semi-flexible Steel Straps 2 that secure the Spike Attachment to the Shaft 5, but do not require a precise fit between the Shaft 5 and the Spike Attachment. The current plan, which may be adjusted, is for the smaller diameter Spike Attachments to have 3 Steel Straps 2, the mid size Spike Attachments would have 4 Steel Straps 2, and the larger diameter Spike Attachments would have 5 Steel Straps 2. At least 2 sizes, i.e., the diameter of the Steel Bar 1, are anticipated within each Spike Attachment size category with various Spike 3 lengths. For Spikes 3 used exclusively for litter retrieving, smaller diameter Spikes 3 may be provided than the Spikes 3 to assist walking for the Spike Attachment design.

The Spike Attachment invention in the drawings is for a mid size diameter Spike Attachment invention. Except for the Steel Bar 1 diameter and the number of Steel Straps 2, the design for the smaller size and larger size Spike Attachments is essentially the same. The number, the width, and the length of Steel Straps 2 can be adjusted or customized to accommodate particular uses or as possible invention improvements are determined.

The Steel Straps 2 proposed in the drawings are from flat thick steel sheet metal sheets that are still semi-flexible. Curved Steel Straps 2 for attachment could be used, but this may be detrimental to the design. Curved Steel Straps for attachment would have less flexibility and may cause unnecessary scuffing and damage to the Shaft 5, while the strength of the welds would be smaller. In some cases curved Steel Straps 2 or from other metals or materials by a mold process for the Spike Attachment may be used, especially to accommodate a precisely machined Shaft 5.

We claim the following:

1. A spike attachment for a walking stick, cane, retrieving stick, or walking assistance device, comprising:

an elongated cylindrical steel bar having a curved outer side surface and a top and bottom, the steel bar having a hole that extends from the top of the bar to the bottom of the bar;

a steel rod having a diameter of generally the same size as the hole in the bar, the steel rod having a spike at one end, wherein the steel rod is inserted in the hole of the bar such that the spike is exposed at the bottom end of the bar and a void is left above the top of the rod and below the top of the bar, wherein the steel rod is welded entirely about its circumference to the bottom of the bar and at the top of the steel rod in the void, wherein the void is filled with welding material;

at least three flat steel straps which are welded circumferentially around the curved outer side surfaces of the steel bar with gaps between the straps, the straps extending upwardly above the top of the steel bar;

wherein, the walking stick, cane, retrieving stick, or walking assistance device is inserted between the steel straps and attached to the straps, above the top surface of the steel bar.

* * * * *